United States Patent [19]

Berry

[11] 4,444,385

[45] Apr. 24, 1984

[54] SHEET FEEDER

[75] Inventor: Jack Berry, Fremont, Calif.

[73] Assignee: Qume Corporation, San Jose, Calif.

[21] Appl. No.: 340,260

[22] Filed: Jan. 18, 1982

[51] Int. Cl.[3] ..... B65H 3/32

[52] U.S. Cl. ..... 271/22; 271/114

[58] Field of Search ..... 271/21, 22, 23, 114, 271/115, 266

[56] References Cited

U.S. PATENT DOCUMENTS

| | | | |
|---|---|---|---|
| 1,114,143 | 10/1914 | Johnson . | |
| 3,503,603 | 2/1968 | Dvorak . | |
| 3,866,901 | 2/1975 | Brock | 271/21 |
| 4,045,015 | 8/1977 | Sardella . | |
| 4,136,861 | 1/1979 | Goff | 271/22 |
| 4,232,860 | 11/1980 | Brown . | |
| 4,277,059 | 7/1981 | Dunning . | |
| 4,290,593 | 9/1981 | Irvine . | |

FOREIGN PATENT DOCUMENTS

| | | |
|---|---|---|
| 1216910 | 12/1970 | United Kingdom . |
| 1394738 | 5/1975 | United Kingdom . |

*Primary Examiner*—Richard A. Schacher

*Attorney, Agent, or Firm*—T. E. Kristofferson; J. M. May

[57] ABSTRACT

In a printer having a sheet feeder associated therewith, means are provided for feeding only the top sheet in a stack of sheets to the printer platen. A feed roller is positioned in contact with the top sheet and is energized a plurality of times prior to the paper clearing two corner separators associated with the sheet feeder, the acceleration and stopping of the feed roller having a tendency to jerk the first sheet of paper out of the stack while leaving the subsequent sheets in the stack. Although several methods can be utilized to energize the feed roller, control signals for energizing the feed roller are preferably generated by the printer microprocessor.

13 Claims, 9 Drawing Figures

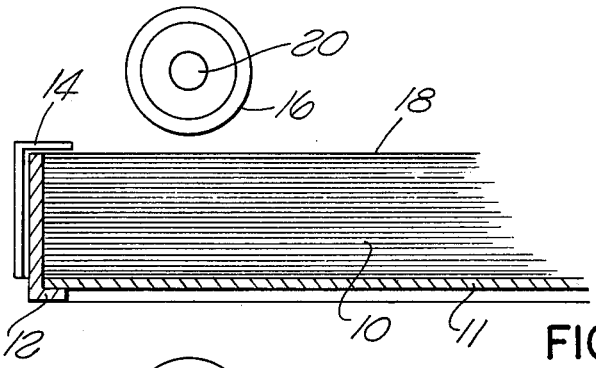
FIG. IA
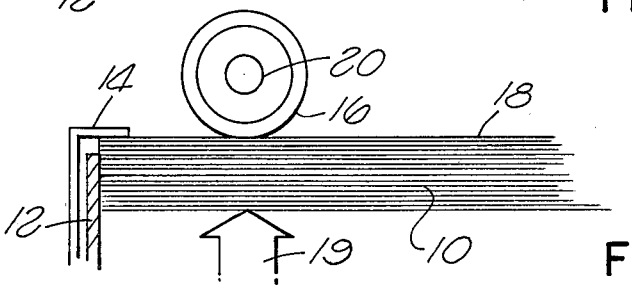
FIG. IB
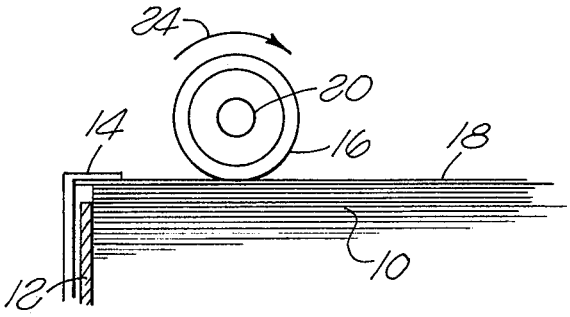
FIG. IC
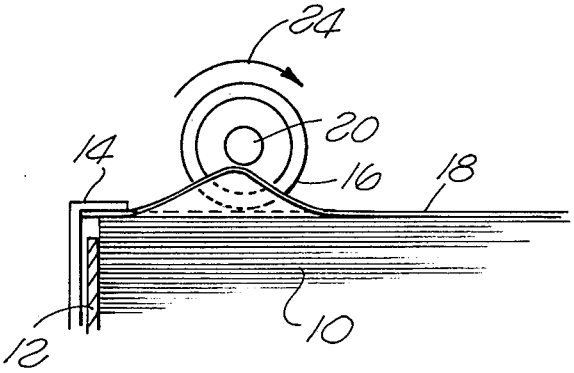
FIG. ID

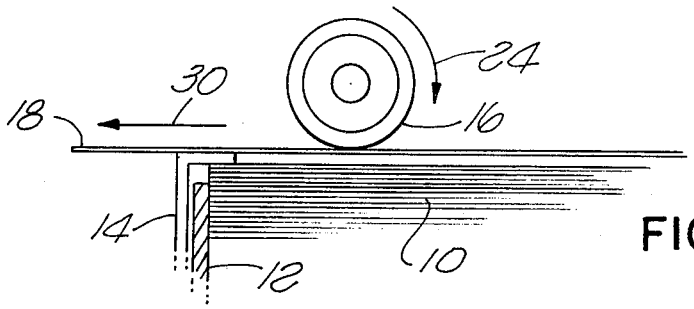
FIG. IE
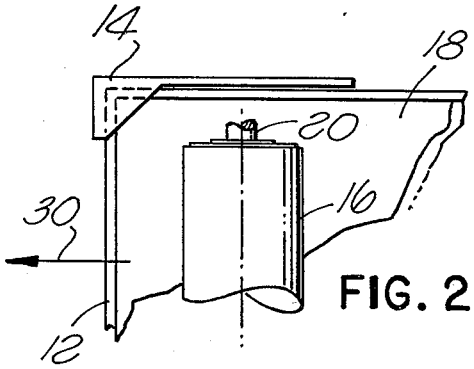
FIG. 2
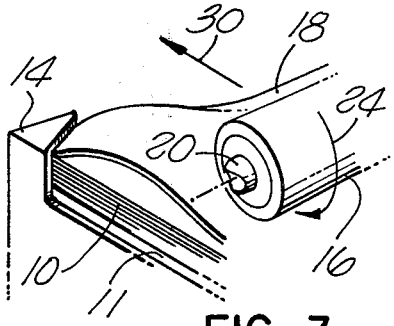
FIG. 3
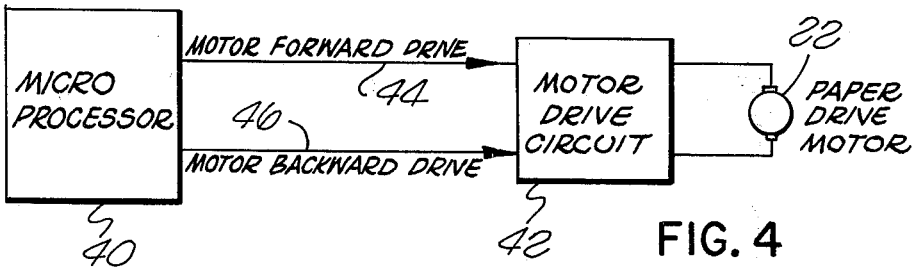
FIG. 4
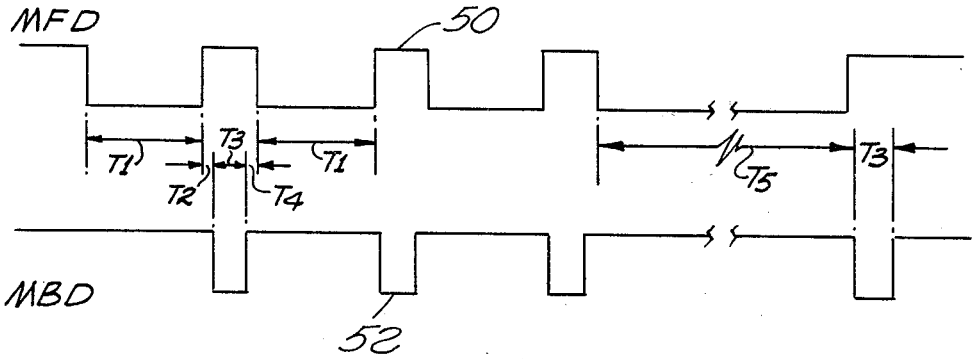
FIG. 5

SHEET FEEDER

BACKGROUND OF THE INVENTION

Typical prior art sheet feeders commonly turned on the feed wheels once for each cycle of sheet feeding to drive the sheet of paper out of the sheet tray. Once a sheet was singly fed, the sheet could be handled and processed by any number of means well known to the art. However, obtaining single sheet feed is difficult and is affected by several factors; the normal force of the drive rollers to the sheet of paper; driver roller to sheet friction, the paper weight, humidity, inner sheet friction, edge welding, rough edges, excessive curl, paper size (out of specification), etc. It would be desirable if a technique could be provided wherein only the first sheet on top of a paper stack can be selectively driven out of the paper stack.

U.S. Pat. No. 4,290,593 describes a technique for removing the top sheet from a stack of sheets. In particular, a stack of sheets is supported in a tray, the tray having corner separators for providing that only one sheet at a time will be fed from the tray. An overhead feed roller is in contact with the top sheet of the stack, the roller being supported on an arm which is spring biased towards the stack. When it is desired to feed the top sheet from the stack, the arm and roller are advanced on a first forward stroke toward the corner separators. The roller, having been in frictional contact with the top sheet, will tend to cause the top sheets to buckle thereby allowing the forward corners of the top sheet to be removed from the corner separators. The arm and roller are then advanced rearwardly until the rearmost position is reached. In its rearward travel, the roller is able to roll upon the top sheet of the stack.

When the roller reaches the rearward end point, it is again advanced forwardly to the initial rest position. With such movement, a thin sheet which had previously been advanced a short distance will be fully advanced. Thicker sheets will be conveyed by the second forward stroke of the cycle if the thicker sheet was not separated from the corner separators on the first stroke due to its greater stiffness.

While the aforementioned patent describes a system for removing a top sheet from a stack of sheets, the disclosed technique is more costly and complex than is desired. For example, a feed brake (or one-way clutch) and arm support are necessary for system operation thereby increasing system cost and decreasing system reliability. Further, two forward feeding strokes are required which necessarily reduces system throughput.

SUMMARY OF THE PRESENT INVENTION

The present invention provides a printer having a sheet feeder associated therewith, the sheet feeder feeding only the top sheet in a stack of sheets to the printer platen. A feed roller positioned in contact with the top sheet is energized a plurality of times prior to the paper clearing two corner separators associated with the sheet feeder, the acceleration and stopping of the feed roller having a tendency to jerk the first sheet of paper out of the stack while leaving the subsequent sheets in the stack. Although several methods can be utilized to energize the feed roller, control signals for energizing the feed roller are preferably generated by the printer microprocessor.

It is an object of the present invention to provide an improved printer sheet feeding system.

It is a further object of the present invention to provide an improved printer sheet feeding system wherein only the first sheet in the paper stack is removed for each cycle of sheet feeding.

It is still a further object of the present invention to provide a printer system having a sheet feeder associated therewith, the sheet feeder feeding only the top sheet in a stack of sheets to the printer platen. A feed roller positioned in contact with the top sheet is energized a plurality of times prior to the paper clearing two corner separators associated with the sheet feeder, the acceleration and stopping of the feed roller having a tendency to jerk the first sheet of paper out of the stack while leaving the subsequent sheets in the stack. Although several methods can be utilized to energize the feed roller, control signals for energizing the feed roller are preferably generated by the printer microprocessor.

It is an object of the present invention to provide an improved sheet feeding system, which is more reliable and less costly than prior art systems.

BRIEF DESCRIPTION OF THE DRAWING

For a better understanding of the invention as well as other objects and further features thereof, reference is made to the following description which is to be read in conjunction with the following figures wherein:

FIGS. 1A–1E are side views of a sheet feeding device illustrating the sequential operation of the present invention;

FIG. 2 is a plan view of a corner portion of the sheet feeding device of the present invention;

FIG. 3 is a side perspective view of the corner portion opposite to the corner portion shown in FIG. 2;

FIG. 4 is a block diagram of a sheet drive motor control system utilized in the present invention; and FIG. 5 is a timing waveform for the block diagram of FIG. 4.

DESCRIPTION OF THE PREFERRED EMBODIMENT

Referring now to FIGS. 1A–1E, a sheet feeding device utilizing the technique of the present invention is illustrated. A stack of sheets 10 is supported in tray 12. Tray 12 preferably has two corner separators 14 (only one shown), one on each side of the forward process direction, for enabling only one sheet at a time to be fed from tray 12 in sequence.

An overhead feed roller 16 (although only one feed roller is shown in the figures and referred to in the description to follow, it should be noted that two or more feed rollers are preferred for system operation) is initially positioned (in FIG. 1A) adjacent the top sheet 18 of the stack 10. Feed roller 16 is supported on shaft 20 which in turn is coupled to a sheet drive motor 22 (shown in FIG. 4), the feed roller 16 rotating in the direction of reference numeral 24 (FIGS. 1C–1E) when drive motor 22 is energized by a motor forward drive pulse as will be explained hereinafter with reference to FIGS. 4 and 5.

FIG. 1B shows feed roller 16 in frictional contact with the top sheet 18 of stack 10. In order to maintain feed roller 16 in frictional contact with top sheet 18 (and subsequent top sheets), a number of alternative techniques can be utilized. For example, a controlled force (such as that produced by springs) biasing feed roller 16 against the paper stack 10 could be coupled to feed roller 16; the bottom plate 11 of the stack 10 could be spring loaded thereby exerting a force on the stack in the direction of arrow 19; by tilting tray 10; or by utilizing an elevator to move plate 11 such that top sheet 18 is in contact with the underside of feed roller 16. When using an elevator, feed roller 16 must be moveable, i.e., by using spring biasing, if the elevator is to perform satisfactorily.

FIG. 1C illustrates the initiation of the sequence which removes top sheet 18 from stack 10. In particular, an initial forward motor drive pulse, or control signal, is applied to motor 22 causing feed roller 16 to rotate in the direction of arrow 24. It should be noted that in the preferred mode of operation wherein two feed rollers are utilized, both feed rollers are controlled by the same control signals so that, for example, if a forward motor drive motor pulse is applied to motor 22, both feed rollers will rotate at the same time and in the same direction. Preferably, and at a predetermined time period thereafter, a motor backward drive pulse, or control signal, is coupled to motor 22 causing the rotation of feed roller 16 to stop a relatively short period of time after the motor backward drive pulse is applied to motor 22.

FIG. 1D illustrates the second rotation of feed roller 16 in the overall feed cycle by coupling a second motor forward drive pulse to motor 22. The rotation of feed roller 16 at this time causes top sheet 18 to buckle, the buckled portion being lifted above the rest of the stack as shown. It should be noted that buckling can be caused to occur on the first motor forward drive pulse if top sheet 18 was initially biased forward into separators 14. At a predetermined time period after the forward drive pulse has been generated, a motor backward pulse is coupled to motor 22 causing the rotation of feed roller 16 to stop. The third motor forward pulse is applied to feed roller 16, the top sheet 18 thus being advanced beyond corner separators 14 as shown in FIG. 1E. It should be further noted that if the buckle is caused to occur on the first motor forward pulse as set forth hereinabove, the top sheet 18 would be advanced beyond corner separators 14 at the end of the second motor forward drive pulse.

Once top sheet 18 is clear of separators 14, only forward drive need be applied to feed roller 16 to advance top sheet 18 in the direction of arrow 30 for further processing downstream of stack 10.

The acceleration and stopping of the feed roller 16 by a series of pulses has the tendency to jerk the first, or top, sheet 18 out of the stack 10 while leaving the subsequent sheets in the stack. Typically, the feed roller 16 is started (energized) three times and stopped (de-energized) three times before the top sheet 18 is advanced beyond corner separators 14.

FIG. 2 is a top plan view of one corner portion of the sheet feeding device of the present invention and shows, inter alia, a corner of top sheet 18 positioned below corner separator 14 and below feed roller 16.

FIG. 3 is a perspective view of the other corner location of the sheet feeding device and illustrates how top sheet 18 is caused to buckle by coaction of the corner separators 14 and the jerking motion produced by the intermittent rotation of feed roller 16 and then advanced from the stack 10.

Referring to FIG. 4, a block diagram of the sheet drive motor control system is illustrated. A microprocessor 40, such as the 8048 microcomputer chip manufactured by Intel Corporation, Santa Clara, California, is coupled to motor drive circuit 42 via control lines 44 and 46. The output of motor drive circuit 42 is connected across sheet feeder drive motor 22. In the preferred embodiment, motor 22 comprises a DC motor although stepping motors and AC motors could also be utilized. Since the present invention is directed to a sheet feeder system and the specific control signals utilized to control the feed roller 16, details of microprocessor 40 and the other control functions provided thereof is not set forth. Suffice to say that microprocessor 40 can be readily programmed to produce the desired motor forward drive control signal 50 and motor backward drive control signal 52 (shown in FIG. 5) and at the correct time sequence. It should also be noted that although microprocessor 40 is preferably utilized to generate the appropriate control signals 50 and 52, other electronic and mechanical techniques can be adapted to provide these signals. The control signals 50 and 52 generated by microprocessor 40 and shown in FIG. 5 are in the form of a pulse sequence.

In operation and referring to FIGS. 4 and 5, microprocessor 40 initially generates a sheet drive motor forward pulse, T1 (referred to as MFD in FIG. 5) on line 44 of approximately 61.5 msec duration which causes feed roller 16 to rotate in the forward, or drive, direction. After a delay T2 (approximately 5 μsec), microprocessor 40 generates a sheet drive motor reverse pulse T3 (referred to as MBD in FIG. 5) on bus 46 of approximately 28.2 msec duration which substantially stops the rotation of feed roller 16. After a delay T4 (approximately 10 μsec), the cycle is repeated twice more (a total of three forward and three reverse drive pulses are applied to the sheet during motor 22 via motor drive circuit 42), the acceleration and stopping of the feed rollers causing the first, or top sheet, to be jerked out of the stack 10 while leaving the other sheets in the stack as set forth hereinabove, such that top sheet 18 is advanced from the stack for further processing. As shown by the timing waveforms, another motor forward pulse T5 of approximately 2 seconds duration is applied to sheet drive motor 22 to further advance the top sheet 18 in the direction of arrow 30 to, for example, a printer registration station (not shown). Finally, a sheet drive motor backward pulse T3 is applied to motor drive circuit 42 to stop rotation of the feed roller 16 thereby completing the feed cycle for removing a top sheet from the stack of sheets.

It should be noted that the sheet drive motor backward pulses provide a relatively fast technique for stopping the rotation of feed roller 16 in the reverse, or non-driving, direction, to increase sheet feeder throughput. Instead of providing backward, or reverse, pulses to stop rotation of feed roller 16, a controlled switch could be provided to alternately turn drive motor 22 on and off. This still would provide the jerking motion required to remove the top sheet 18 from the stack 10. However, sheet feeder throughput in this case would not be as fast as that wherein the feed roller is stopped by the application of backward pulses as previously described.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. Apparatus for feeding a single sheet from a stack of sheets comprising:

(a) support means for supporting a stack of sheets;

(b) separating means positioned at laterally opposed front corners of the top of the stack of sheets;

(c) feed roller means fixedly positioned above the stack and in frictional contact with said top sheet of the stack of sheets;

(d) drive means for causing said feed roller means to rotate in a first direction corresponding to the advancement of said top sheet from said stack towards said separating means in response to a first control signal; and (e) means for applying at least three of said first control signals to said drive means and thereby causing said feed roller to rotate in said first direction at least two separate times while the front corners of said top sheet are in contact with said separating means and thereafter to rotate in said first direction a third separate time during the further advancement of said top sheet from said stack.

2. The apparatus as defined in claim 1 wherein a second control signal is applied to said drive means a predetermined time period after each of the first two of said first control signals are applied to said drive means whereby the rotation of said feed roller means is stopped after being caused to rotate by said first control signals.

3. The apparatus as defined in claim 2 wherein the period of said first control signal is greater than the period of said second control signal.

4. The apparatus as defined in claim 1 wherein said feed roller means comprises two feed rollers.

5. The apparatus as defined in claim 1 wherein said control signals are generated by a microprocessor.

6. The apparatus as defined in claim 1 wherein said drive means is de-energized a predetermined time period subsequent to each time said drive means is energized whereby said feed roller means is caused to stop its rotation.

7. The apparatus as defined in claim 1 wherein the energization of said drive means while said corners are in contact with said separating means causes said top sheet to buckle.

8. A method of feeding a single sheet from a stack of sheets comprising the steps of:

(a) supporting a stack of sheets;

(b) restraining a leading edge of at least an exposed outer sheet of the stack of sheets;

(c) locating at least one feed roller at a fixed position relative to said stack and in frictional contact with said exposed outer sheet; and (d) causing said feed roller alternately to rotate in a first direction and to substantially stop at least two separate times while said leading edge is restrained by said separating means and to again rotate in said first direction thereby causing said exposed outermost sheet to buckle relative to the remaining sheets in said stack as said leading edge is restrained as a result of coaction of said restraining and the jerking motion imparted to said outermost sheet by the intermittent rotation of said feed roller and then to advance in the direction of said leading edge.

9. The method as defined in claim 8 wherein said apparatus further includes drive means coupled to said feed roller for driving said feed roller in said first direction when energized by a first control signal and for driving said feed roller in a second direction when energized by a second control signal and said second control signal is applied to said drive means a predetermined time period after each of predetermined ones of said first control signals are applied to said drive means whereby the rotation of said feed roller means may be stopped in a relatively short period of time after being caused to rotate by said first control signals.

10. The method as defined in claim 9 wherein the period of said first control signal is greater than the period of said second control signal.

11. The method as defined in claim 8 wherein said control signals are generated by a microprocessor.

12. The method as defined in claim 8 wherein said drive means is de-energized a predetermined time period subsequent to each time said drive means is energized whereby said feed roller means is caused to stop its rotation.

13. The method as defined in claim 8 wherein the energization of said drive means causes said top sheet to buckle.

* * * * *

UNITED STATES PATENT OFFICE
CERTIFICATE OF CORRECTION

PATENT NO. : 4,444,385

DATED : April 24, 1984

INVENTOR(S) : Jack Beery

It is certified that error appears in the above-identified patent and that said Letters Patent are hereby corrected as shown below:

The name of the inventor should be ---Jack Beery---

Signed and Sealed this

*Twenty-sixth* Day of *February 1985*

[SEAL]

*Attest:*

DONALD J. QUIGG

*Attesting Officer* *Acting Commissioner of Patents and Trademarks*